US010012432B2

(12) United States Patent
Chantant et al.

(10) Patent No.: US 10,012,432 B2
(45) Date of Patent: Jul. 3, 2018

(54) METHOD AND APPARATUS FOR COOLING A HYDROCARBON STREAM

(75) Inventors: François Chantant, The Hague (NL); Frederick Jan Van Dijk, Amsterdam (NL); Marco Dick Jager, The Hague (NL)

(73) Assignee: SHELL OIL COMPANY, Houston, TX (US)

( * ) Notice: Subject to any disclaimer, the term of this patent is extended or adjusted under 35 U.S.C. 154(b) by 1099 days.

(21) Appl. No.: 12/668,553

(22) PCT Filed: Jul. 10, 2008

(86) PCT No.: PCT/EP2008/059046
§ 371 (c)(1),
(2), (4) Date: Jan. 11, 2010

(87) PCT Pub. No.: WO2009/007435
PCT Pub. Date: Jan. 15, 2009

(65) Prior Publication Data

US 2010/0186929 A1 Jul. 29, 2010

(30) Foreign Application Priority Data

Jul. 12, 2007 (EP) ..... 07112351

(51) Int. Cl.
*F25J 1/02* (2006.01)
*F25J 1/00* (2006.01)
*F25B 9/00* (2006.01)

(52) U.S. Cl.
CPC ..... *F25J 1/0022* (2013.01); *F25B 9/006* (2013.01); *F25J 1/0042* (2013.01); *F25J 1/0052* (2013.01);
(Continued)

(58) Field of Classification Search
CPC . F25B 7/00; F25B 2700/13–2700/1353; F25B 2700/2116–2700/21175; F25J 1/02;
(Continued)

(56) References Cited

U.S. PATENT DOCUMENTS 3,742,721 A 7/1973 Bourguet et al.
3,808,826 A 5/1974 Harper et al. ..... 62/9
(Continued)

FOREIGN PATENT DOCUMENTS

EP 0893665 1/1999
EP 1092933 4/2001
(Continued)

*Primary Examiner* — Brian King

(57) ABSTRACT

A mixed refrigerant stream (10) comprising a first mixed refrigerant is passed through one or more heat exchangers (12) to provide a cooled mixed refrigerant stream (20). At least a fraction of a cooling stream (30) comprising a second mixed refrigerant is expanded (14) to provide one or more expanded cooling streams (40*a*), at least one of which may be passed through one or more of the heat exchangers (12), to cool the mixed refrigerant stream (10) thereby providing the cooled mixed refrigerant stream (20) which is used to cool (22) a hydrocarbon stream (70). The temperature (T1) and the flow (F1) of at least part of the cooled mixed refrigerant stream (20) is monitored, and the flow (F2) of the cooling stream (30) is controlled using the flow F1 and the temperature T1.

12 Claims, 4 Drawing Sheets

(52) U.S. Cl.
CPC ..... *F25J 1/0055* (2013.01); *F25J 1/0057* (2013.01); *F25J 1/0214* (2013.01); *F25J 1/0244* (2013.01); *F25J 1/0283* (2013.01); *F25J 1/0292* (2013.01); *F25J 1/0295* (2013.01)

(58) Field of Classification Search
CPC ..... F25J 1/0243; F25J 1/0252; F25J 1/0254; F25J 2280/50
USPC ..... 62/606, 611, 612, 614
See application file for complete search history.

(56) References Cited

U.S. PATENT DOCUMENTS

| | | | | |
|---|---|---|---|---|
| 4,404,008 | A | 9/1983 | Rentler et al. | 62/11 |
| 4,698,080 | A | 10/1987 | Gray et al. | |
| 4,809,154 | A | 2/1989 | Newton | 364/148 |
| 4,901,533 | A | 2/1990 | Fan et al. | |
| 5,791,160 | A * | 8/1998 | Mandler | F25J 1/0022 62/611 |
| 6,158,240 | A * | 12/2000 | Low et al. | 62/611 |
| 6,272,882 | B1 | 8/2001 | Hodges et al. | 62/613 |
| 6,347,531 | B1 | 2/2002 | Roberts et al. | |
| 6,370,910 | B1 * | 4/2002 | Grootjans | F25B 39/04 62/509 |
| 6,789,394 | B2 | 9/2004 | Elion et al. | |
| 7,266,975 | B2 | 9/2007 | Hupkes et al. | |
| 2004/0093896 | A1 | 5/2004 | Elion et al. | 62/656 |
| 2004/0255615 | A1 * | 12/2004 | Hupkes et al. | 62/606 |
| 2006/0162378 | A1 | 7/2006 | Roberts | |
| 2006/0283206 | A1 * | 12/2006 | Rasmussen | F01D 15/005 62/619 |
| 2007/0227185 | A1 * | 10/2007 | Stone | F25B 9/006 62/611 |
| 2009/0217701 | A1 * | 9/2009 | Minta et al. | 62/612 |

FOREIGN PATENT DOCUMENTS

| | | | |
|---|---|---|---|
| JP | 2005164235 A | 6/2005 | |
| JP | 11092770 | 5/2011 | |
| SU | 1458663 | 2/1989 | F25J 1/00 |
| WO | 2001081845 | 11/2001 | |
| WO | 2007021351 | 2/2007 | |

* cited by examiner

METHOD AND APPARATUS FOR COOLING A HYDROCARBON STREAM

The present application claims priority from European Patent Application 07112351.7 filed 12 Jul. 2007.

BACKGROUND OF THE INVENTION

The present invention relates to a method and apparatus for cooling, optionally liquefying, a hydrocarbon stream, particularly but not exclusively natural gas. In other aspects, the present invention relates to a method and apparatus for cooling a mixed refrigerant stream.

Several methods of liquefying a natural gas stream, thereby obtaining liquefied natural gas (LNG) are known. It is desirable to liquefy a natural gas stream for a number of reasons. As an example, natural gas can be stored and transported over long distances more readily as a liquid than in gaseous form because it occupies a smaller volume and does not need to be stored at high pressure.

U.S. Pat. No. 4,404,008 describes a method for cooling and liquefying a methane-rich gas stream which is first heat exchanged against a single component refrigerant, such as propane, and then a multi-component refrigerant, such as lower hydrocarbons. The single component refrigerant is also used to cool the multi-component refrigerant subsequent to the multi-component refrigerant's compression. The arrangement shown in U.S. Pat. No. 4,404,008 is now considered to be a common methodology for liquefying natural gas where the multi-component refrigerant is pre-cooled by the single component refrigerant by passing them through the same first heat exchanger.

An object of U.S. Pat. No. 4,404,008 is to shift refrigeration load from the multi-component refrigeration cycle to the single component refrigeration cycle. This is achieved by utilising inter-stage cooling of the multi-component refrigerant cycle.

However, control of a multi-component pre-cooling refrigeration cycle can be unsatisfactory using existing methods.

SUMMARY OF THE INVENTION

In one aspect, the present invention provides a method of cooling a hydrocarbon stream, such as a natural gas stream, comprising at least the steps of:

(a) providing a mixed refrigerant stream comprising a first mixed refrigerant;

(b) passing the mixed refrigerant stream through one or more heat exchangers to provide a cooled mixed refrigerant stream;

(c) monitoring the temperature (T1) and the flow (F1) of at least part of the cooled mixed refrigerant stream;

(d) providing a cooling stream comprising a second mixed refrigerant;

(e) monitoring the flow (F2) of at least part of the cooling stream provided in step (d);

(f) expanding at least a fraction of the cooling stream to provide one or more expanded cooling streams;

(g) passing at least one of the one or more expanded cooling streams through one or more of the heat exchangers of step (b) to cool the mixed refrigerant stream thereby providing the cooled mixed refrigerant stream;

(h) controlling the flow (F2) of the cooling stream using the flow (F1) and the temperature (T1) of at least part of the cooled mixed refrigerant stream;

(i) using the cooled mixed refrigerant stream to cool the hydrocarbon stream.

In another aspect, the invention provides an apparatus for cooling a hydrocarbon stream, such as a natural gas stream, comprising at least:

a flow monitor to monitor the flow (F2) of at least part of a cooling stream comprising a second mixed refrigerant;

one or more expanders to expand at least a fraction of the cooling stream thereby providing one or more expanded cooling streams;

one or more heat exchangers arranged to receive and cool a mixed refrigerant stream comprising a first mixed refrigerant, against at least one of the one or more expanded cooling streams, thereby providing a cooled mixed refrigerant stream;

a temperature monitor and a flow monitor for monitoring the temperature (T1) and the flow (F1) of at least part of the cooled mixed refrigerant stream;

a controller to control the flow (F2) of the cooling stream using the measured values of the flow (F1) and the temperature (T1) of the at least part of the cooled mixed refrigerant stream;

at least one main heat exchanger arranged downstream of the one or more said heat exchangers to receive the cooled mixed refrigerant stream and the hydrocarbon stream and to cool the hydrocarbon stream against the cooled mixed refrigerant stream.

In still another aspect, the invention provides a method of cooling a mixed refrigerant stream, comprising at least the steps of:

(a) providing a mixed refrigerant stream comprising a first mixed refrigerant;

(b) passing the mixed refrigerant stream through one or more heat exchangers to provide a cooled mixed refrigerant stream;

(c) monitoring the temperature (T1) and the flow (F1) of at least part of the cooled mixed refrigerant stream;

(d) providing a cooling stream comprising a second mixed refrigerant;

(e) monitoring the flow (F2) of at least part of the cooling stream provided in step (d);

(f) expanding at least a fraction of the cooling stream to provide one or more expanded cooling streams;

(g) passing at least one of the one or more expanded cooling streams through one or more of the heat exchangers of step (b) to cool the mixed refrigerant stream thereby providing the cooled mixed refrigerant stream; and (h) controlling the flow (F2) of the cooling stream using the flow (F1) and the temperature (T1) of at least part of the cooled mixed refrigerant stream, wherein a hydrocarbon stream, such as a natural gas stream, also passes through at least one of the heat exchangers of step (b) where it is cooled to produce a cooled hydrocarbon stream.

In yet another aspect, the invention provides an apparatus for cooling a mixed refrigerant stream, comprising at least:

a flow monitor to monitor the flow (F2) of at least part of a cooling stream comprising a second mixed refrigerant;

one or more expanders to expand at least a fraction of the cooling stream thereby providing one or more expanded cooling streams;

one or more heat exchangers arranged to receive and cool a mixed refrigerant stream comprising a first mixed refrigerant and a hydrocarbon stream, such as a natural gas stream, against at least one of the one or more expanded cooling streams, thereby providing a cooled mixed refrigerant stream;

a temperature monitor and a flow monitor for monitoring the temperature (T1) and the flow (F1) of at least part of the cooled mixed refrigerant stream;

a controller to control the flow (F2) of the cooling stream using the measured values of the flow (F1) and the temperature (T1) of the at least part of the cooled mixed refrigerant stream.

BRIEF DESCRIPTION OF THE DRAWINGS

Embodiments of the present invention will now be described by way of example only, and with reference to the accompanying non-limiting drawings in which.

For the purpose of this description, a single reference number will be assigned to a line as well as a stream carried in that line. Same reference numbers refer to similar components.

DETAILED DESCRIPTION OF THE REFERENCED EMBODIMENT

Figure 1:
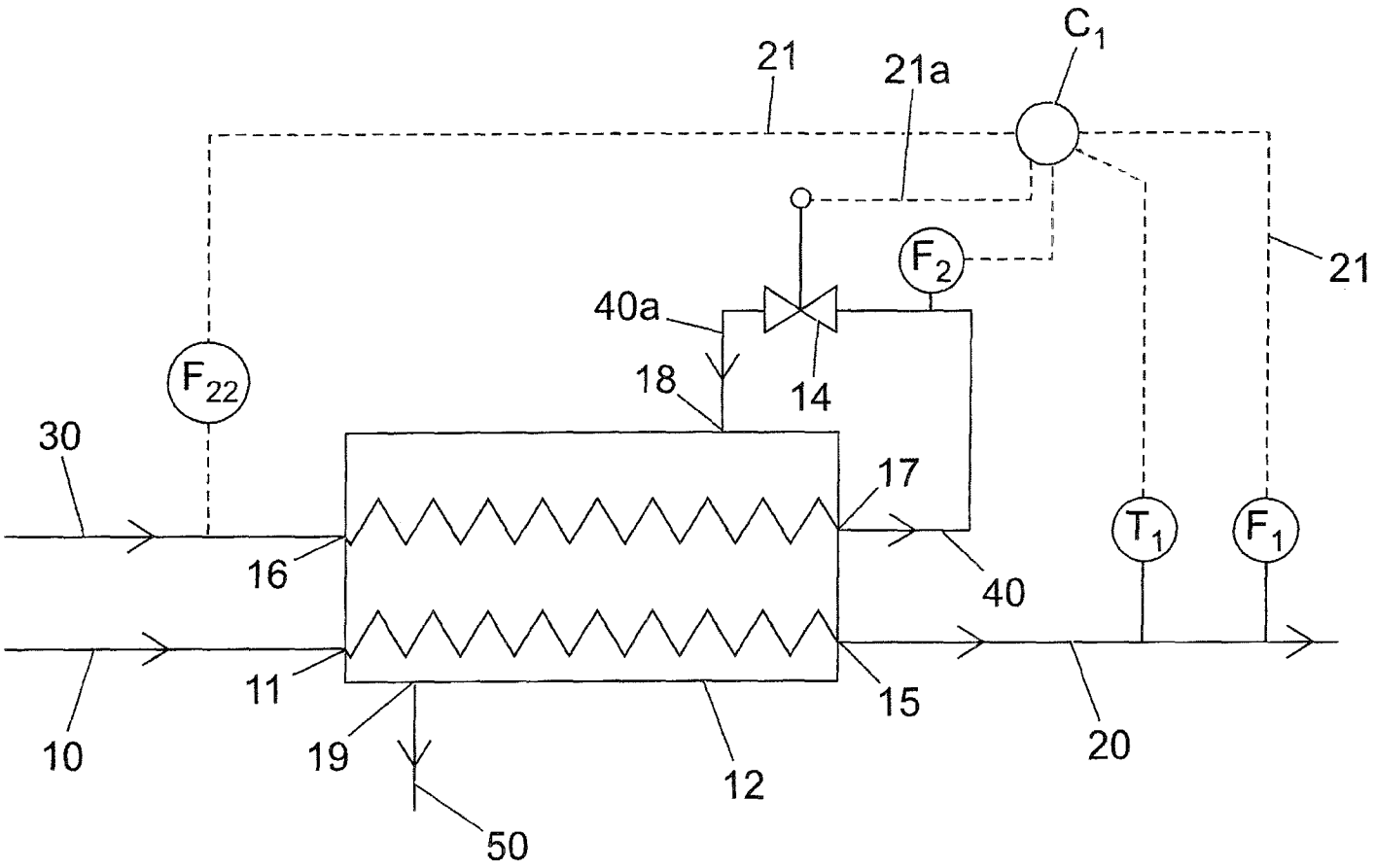
FIG. 1 is a first general scheme for a method of cooling a mixed refrigerant stream.

In the methods and apparatuses disclosed herein, a cooled mixed refrigerant stream is generated using a cooling stream, by steps including:

- passing the mixed refrigerant stream through one or more heat exchangers to provide a cooled mixed refrigerant stream;
- monitoring the temperature (T1) and the flow (F1) of at least part of the cooled mixed refrigerant stream;
- monitoring the flow (F2) of at least part of the cooling stream;
- expanding at least a fraction of the cooling stream to provide one or more expanded cooling streams;
- passing at least one of the one or more expanded cooling streams through one or more of the heat exchangers to cool the mixed refrigerant stream thereby providing the cooled mixed refrigerant stream.

The flow (F2) of the cooling stream is controlled using the flow (F1) and the temperature (T1) of at least part of the cooled mixed refrigerant stream.

Thus, the flow of the cooling stream is controlled using both the flow and temperature of at least part of the cooled mixed refrigerant stream, as monitoring both the temperature and flow of at least part of the cooled mixed refrigerant stream provides more accurate and more immediate feedback to the operation of the flow of at least part of the cooling stream, which can therefore more rapidly be adjusted.

Moreover, more immediate feedback, adjustment and control of the flow of the cooling stream increases the efficiency of the compressor(s), more particularly the driver(s) of the compressors(s), of the mixed refrigerant stream and/or the cooling stream. This reduces the power consumption of a method of cooling a mixed refrigerant stream, especially one used for cooling, optionally liquefying, a hydrocarbon stream.

Another advantage is that the amount, i.e. mass and/or volume, of the cooled mixed refrigerant stream can be more rapidly adjusted to better match the subsequent cooling duty of the mixed refrigerant stream, in particular to provide an increased amount of mixed refrigerant stream, and thus an increased amount of cooled and/or liquefied hydrocarbon stream such as LNG provided thereby.

Monitoring and controlling the flow of a stream in the context of the present disclosure is understood to include in particular monitoring and controlling the flow rate. Monitoring or measuring of flow and temperature may be done using any suitable sensor for flow and temperature. There are many of such sensors known in the art.

The mixed refrigerant stream preferably has a composition comprising one or more of the groups selected from: nitrogen, methane, ethane, ethylene, propane, propylene, butanes and pentanes. This is referred to in the present description and claims as the first mixed refrigerant.

The cooling stream is also a mixed refrigerant stream, as hereinbefore defined. It comprises a second mixed refrigerant, optionally having a different composition to that of the first mixed refrigerant in the mixed refrigerant stream.

The expanding of the at least the fraction of the cooling stream may involve passing the fraction of the cooling stream through an expander, which may be suitably provided in the form of a valve, optionally supplemented by or replaced by other other valves or expanders such as a turbine.

The cooling stream, or at least part thereof, may also pass through the one or more of the heat exchangers cooling the mixed refrigerant stream, to provide a cooler cooling stream before expanding it. Instead or in addition, the cooling stream may also pass through one or more other heat exchangers (so as to be cooled) through which the mixed refrigerant stream does not pass.

The heat exchanger(s) in step (b) of the present invention may be one or more selected from the group comprising: one or more plate/fin heat exchangers, one or more spool wound heat exchangers, or a combination of both.

Where the cooling stream passes through one or more of the heat exchangers before expanding, the flow of the cooling stream may be monitored either prior to any one or any number of the heat exchangers, or after one of or any number of the heat exchangers, but prior to expanding at least a fraction of the cooling stream, suitably through an expander, e.g. in the form of one or more valves.

In another embodiment of the present invention, the mixed refrigerant stream is passed through any number of 1 to 6 heat exchangers, preferably not more than 3 heat exchangers, more preferably not more than 2 heat exchangers.

Preferably, in particular where a plurality of heat exchangers is employed, an expanded cooling stream is passed through each heat exchanger cooling the mixed refrigerant stream. In this arrangement, the cooling stream may be split, separated and/or divided before and/or after each heat exchanger, a fraction of which is passed directly into one or more subsequent heat exchangers involved in step (b), and part of which is expanded through one or more expanders such as valves to provide one or more expanded cooling streams for one or more of the heat exchangers.

Optionally, both the temperature and the flow of the cooled mixed refrigerant stream are monitored after each heat exchanger through which it passes.

Preferably, the average molecular weight of the cooling stream is greater than the average molecular weight of the mixed refrigerant stream.

The heat exchangers used to generate the cooled mixed refrigerant stream may be considered "pre-cooling" heat exchangers.

The cooled mixed refrigerant stream is suitably used to cool, preferably liquefy, a hydrocarbon stream. To this end, it may be subsequently passed into one or more further heat exchangers, in particular one or more main cryogenic heat exchangers used to liquefy the hydrocarbon stream, such as natural gas.

Using the cooled mixed refrigerant stream to cool the hydrocarbon stream may thus comprise passing the cooled mixed refrigerant stream through at least one main heat exchanger, and passing the hydrocarbon stream through the at least one main heat exchanger to be cooled by the cooled mixed refrigerant stream or at least part thereof.

Generally, this may be embodied in methods and apparatuses for cooling the hydrocarbon steam, which involve a first cooling stage which includes one or more of the pre-cooling heat exchangers through which passes the mixed refrigerant stream, optionally also the hydrocarbon stream, and the cooling stream; and a second cooling stage which includes the at least one main heat exchanger, through which the cooled mixed refrigerant stream and the hydrocarbon stream (which may be a cooler hydrocarbon stream if it has passed through a pre-cooling heat exchanger) pass, to provide a cooled hydrocarbon stream.

The hydrocarbon stream may be any suitable gas stream to be cooled, but is usually a natural gas stream obtained from natural gas or petroleum reservoirs. As an alternative, the natural gas stream may also be obtained from another source, also including a synthetic source such as a Fischer-Tropsch process.

Usually, a natural gas stream is comprised substantially of methane. Preferably the hydrocarbon stream to be cooled comprises at least 60 mol % methane, more preferably at least 80 mol % methane.

Depending on the source, the natural gas may contain varying amounts of hydrocarbons heavier than methane such as ethane, propane, butanes and pentanes, as well as some aromatic hydrocarbons. The natural gas stream may also contain non-hydrocarbons such as $H_2O$, $N_2$, $CO_2$, $H_2S$ and other sulphur compounds, and the like.

If desired, the hydrocarbon stream containing the natural gas may be pre-treated before use. This pre-treatment may comprise removal of undesired components such as $CO_2$ and $H_2S$, or other steps such as pre-cooling, pre-pressurizing or the like. As these steps are well known to the person skilled in the art, they are not further discussed here.

Hydrocarbons heavier than methane also generally need to be removed from natural gas for several reasons, such as having different freezing or liquefaction temperatures that may cause them to block parts of a methane liquefaction plant. Removed $C_{2-4}$ hydrocarbons can be used as a source of Liquefied Petroleum Gas (LPG).

The term "hydrocarbon stream" also includes a composition prior to any treatment, such treatment including cleaning, dehydration and/or scrubbing, as well as any composition having been partly, substantially or wholly treated for the reduction and/or removal of one or more compounds or substances, including but not limited to sulphur, sulphur compounds, carbon dioxide, water, and $C_2^+$ hydrocarbons.

Optionally, a hydrocarbon stream desired to be cooled is passed through at least one of the heat exchangers through which the mixed refrigerant stream and the cooling stream pass. This arrangement includes passage of the hydrocarbon stream through all the said heat exchangers, or one or more said heat exchangers, usually at least the final heat exchanger in a series of heat exchangers of one stage of a cooling, optionally liquefying process.

The cooled mixed refrigerant stream may be subsequently separated into a lighter stream and a heavier stream prior to passing through any further heat exchanger such as the main heat exchanger. In this instance, the flow of the heavier stream may be additionally monitored, or alternatively monitored in place of monitoring the flow of at least part of the cooled mixed refrigerant stream described hereinbefore.

The measured values for the temperature and flow of the cooled mixed refrigerant stream and for the flow of the cooling stream may suitably be passed to a controller, which controls the expanding in step (f), for instance by controlling the expander such as the valve.

The method of cooling a hydrocarbon stream extends to liquefying a hydrocarbon stream such as natural gas to provide a liquefied hydrocarbon stream such as liquefied natural gas.

FIG. 1 shows a general scheme for cooling a mixed refrigerant stream 10, via inlet 11, through one or more heat exchangers, represented in FIG. 1 as a single heat exchanger 12, to provide a cooled mixed refrigerant stream 20 through outlet 15.

The mixed refrigerant stream 10 comprises a first mixed refrigerant which may comprise one or more of the groups selected from: nitrogen, methane, ethane, ethylene, propane, propylene, butanes and pentanes.

Preferably, the mixed refrigerant stream 10 comprises <10 mol % $N_2$, 30-60 mol % $C_1$, 30-60 mol % $C_2$, <20 mol % $C_3$ and <10% $C_4$; having a total of 100%.

FIG. 1 shows the temperature T1 and flow F1 of the cooled mixed refrigerant stream 20 being monitored. The monitoring and measuring of temperature and flow of a stream can be carried out by any temperature or flow monitor in the form of any known unit, device or other apparatus known in the art.

FIG. 1 also shows a cooling stream 30. The cooling stream 30 comprises a second mixed refrigerant, being a mixture of two or more components such as nitrogen and one or more hydrocarbons. Suitably, it has a higher average molecular weight than first mixed refrigerant in the mixed refrigerant stream 10. The cooling stream preferably comprises 0-20 mol % $C_1$, 20-80 mol % $C_2$, 20-80 mol % $C_3$, <20 mol % $C_4$, <10 mol % $C_5$; having a total of 100%.

The cooling stream 30 passes via inlet 16 into and through the heat exchanger 12 via outlet 17 to provide a cooler cooling stream 40 prior to an expander, here shown in the form of valve 14. Alternatively, the cooling stream 30 need not pass through the heat exchanger 12 prior to reaching the valve 14, or further alternatively, the cooling stream 30 may pass through one or more other heat exchangers (not shown) instead of or in addition to the heat exchanger 12 shown in FIG. 1 prior to the valve 14.

The valve 14 allows expansion of the cooler cooling stream 40 (or the cooling stream 30) to provide an expanded cooling stream **40*a* which passes back into the heat exchanger 12 via inlet 18. The expanded cooling stream 40*a* is significantly cooler than other streams in the heat exchanger 12, thereby providing cooling to such other streams, and passing out of the heat exchanger 12 through outlet 19 to provide an outlet stream 50**.

The flow F2 of the cooling stream 30 can be monitored and optionally measured either prior to its entry into the heat exchanger 12 at a point referenced F22 in FIG. 1, or preferably after passage through the heat exchanger 12 at a point referenced F2 in FIG. 1 on the cooler cooling stream 40. The relationship between the flow of the cooling stream 30 into the heat exchanger 12 and the cooler cooling stream 40 after the heat exchanger 12 is known in the art, such that monitoring using the flow F22 is able to provide the same information in relation to the method of the present invention at monitoring using the flow F2. Therefore, in the description and claims, where flow F2 is mentioned it is understood to cover either F2 itself, and/or flow F22 as well.

Likewise, where flow F1 is used, this is intended to cover monitoring and/or measuring of at least part of the flow upstream of the heat exchanger 12, e.g. in line 10.

Measured values for the temperature T1 and flow F1 of the cooled mixed refrigerant stream 20, and for the flow F2 of cooler cooling stream 40 (and/or the flow F22 of the cooling stream 30), are passed via lines 21 to a controller C1 which controls operation of the valve 14 via line 21*a*. Control of the valve 14 relates to the flow F2 of the cooler cooling stream 40 (and/or flow F22), as well as the flow of the expanded cooling stream 40*a* into the heat exchanger 12, (and therefore the degree of cooling able to be provided by the expanded cooling stream 40*a* in the heat exchanger 12, and thus the degree of cooling to and of the mixed refrigerant stream 20).

Thus, it is also possible to control the temperature T1 of the mixed refrigerant stream 20 by operation of the valve 14 and knowledge of the flow F2 of the cooler cooling stream (and/or the flow F22) of the cooling stream 30, so as to subsequently optimise the temperature T1 of the cooled mixed refrigerant stream 20. The benefits and advantages of this are described hereinafter.

Figure 2:
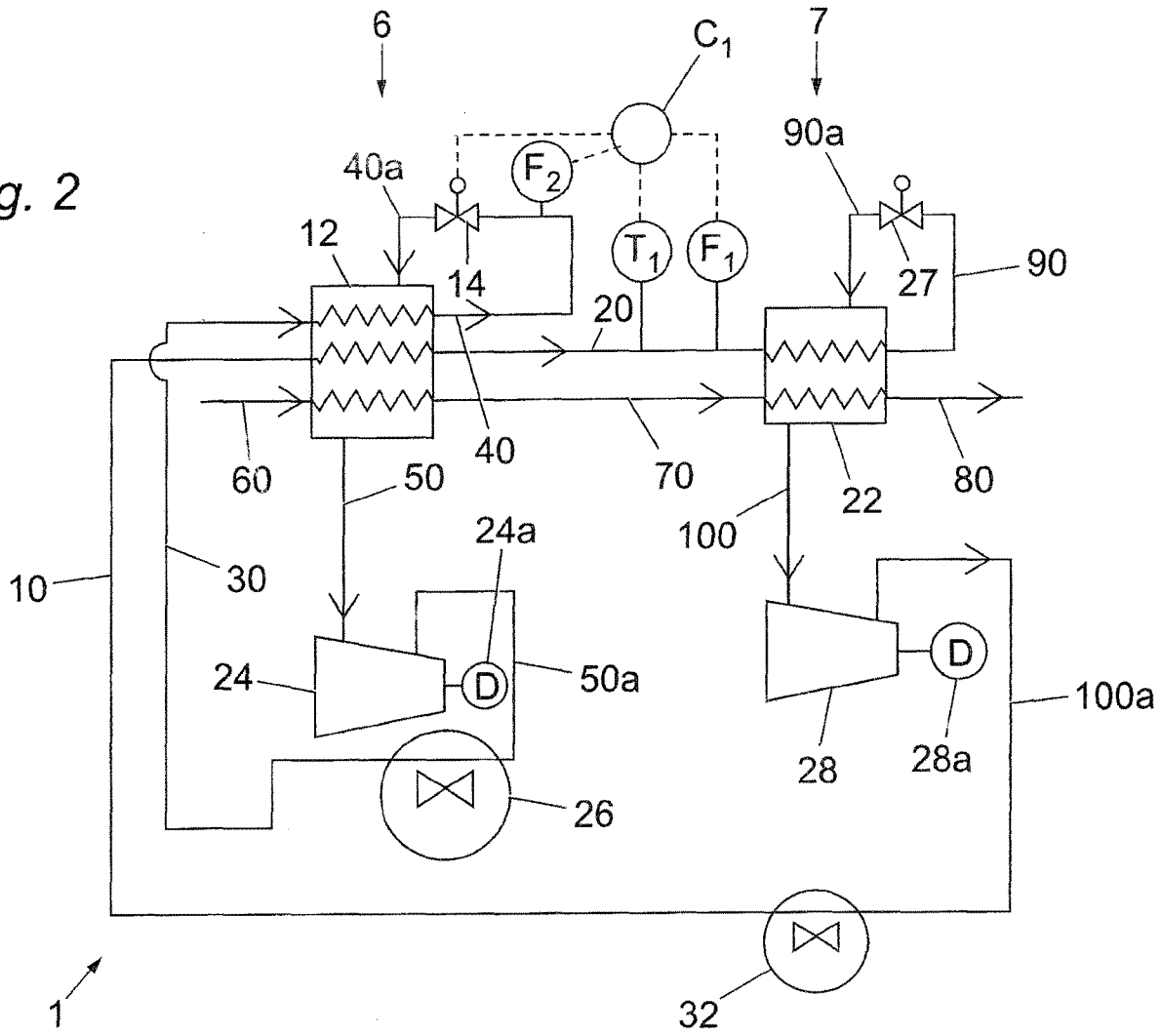
FIG. 2 is a method of cooling a hydrocarbon stream, using the scheme of FIG. 1.

FIG. 2 shows a cooling facility 1 for a method of cooling, preferably liquefying, a hydrocarbon stream 60, which hydrocarbon stream 60 is preferably natural gas. The hydrocarbon stream 60 has preferably been treated to separate out at least some heavy hydrocarbons, and to separate out impurities such as carbon dioxide, nitrogen, helium, water, sulfur and sulfur compounds, including but not limited to acid gases.

The hydrocarbon stream 60 passes through a first cooling stage 6 which includes one or more first heat exchangers being the same or similar to the heat exchanger(s) 12 shown in FIG. 1. Preferably, the one or more first heat exchangers in FIG. 2 are pre-cooling heat exchangers 12 adapted to cool the hydrocarbon stream 60 to a temperature below 0° C., more preferably to a temperature between −10° C. and −70° C.

Also passing through the pre-cooling heat exchanger(s) 12 are a cooling stream 30 and a mixed refrigerant stream 10. The operation of the pre-cooling heat exchanger(s) 12 is similar to that described herein above for the arrangement in FIG. 1, such that from the pre-cooling heat exchanger(s) 12 is a cooler cooling stream 40 which passes through a valve 14 to be expanded, and to provide an expanded cooling stream 40*a* which, being cooler than all other streams in the heat exchanger(s) 12, provides cooling thereto, prior to exiting as a first stage outflow stream 50. In this way, the mixed refrigerant stream 20 is provided as a cooled mixed refrigerant stream 20, and the hydrocarbon stream 60 is cooled to provide a cooler hydrocarbon stream 70.

The temperature T1 and flow F1 of the cooled mixed refrigerant stream 20 are monitored, and measured values passed back to a controller C1. The measured value of the flow F2 of the cooler cooling stream 40 is also passed back to a controller C1.

The cooled mixed refrigerant stream 20 and the cooled hydrocarbon stream 70 then pass to a second cooling stage 7 involving one or more second heat exchangers 22, preferably a main cryogenic heat exchanger adapted to further reduce the temperature of the cooler hydrocarbon stream 70 to below −100° C., more preferably to liquefy the cooled hydrocarbon stream 70, to provide a cooled, preferably liquefied, hydrocarbon stream 80. Where the hydrocarbon stream 60 is natural gas, the main heat exchanger preferably provides liquefied natural gas having a temperature below −140° C.

The cooled mixed refrigerant stream 20 also passes through the main heat exchanger 22 to provide a further cooled mixed refrigerant stream 90, which passes through a main valve 27 to provide an expanded mixed refrigerant stream 90*a*, which, being cooler than all other streams in the main heat exchanger 22, provides cooling to all other such streams, and then outflows as a second stage outflow stream 100.

This second stage outflow stream 100 is compressed by one or more main refrigerant compressors 28 in a manner known in the art, to provide a compressed refrigerant stream 100*a*, which can then be cooled by one or more ambient coolers 32, such as water and/or air coolers known in the art, so as to provide a mixed refrigerant stream 10 ready for recirculation into the pre-cooling heat exchanger(s) 12. The main refrigerant compressor 28 is driven by a driver 28*a*, which may be one or more gas turbines, steam turbines and/or electric drives, known in the art.

Similarly, the first stage outflow stream 50 from the pre-cooling heat exchanger(s) 12 is compressed by one or more pre-cooling compressor(s) 24, to provide a compressed stream 50*a*, which passes through one or more ambient coolers 26 such as water and/or air coolers, so as to provide the cooling stream 30 ready for recirculation and reintroduction into the pre-cooling heat exchanger(s) 12. The pre-cooling compressor is driven by one or more drivers 24*a* known in the art such as gas turbines, steam turbines, electrical drivers, etc.

The compressor drivers 24*a*, 28*a* are usually significant energy users and usually require a significant proportion of the total energy input for the liquefaction facility 1 of FIG. 2. The greatest efficiency for compressor drivers such as gas turbines are to maintain them at a constant speed, and more preferably at a 'full' speed. Thus, variation of the speed of such drivers is generally not desired and decreases their efficiency, as does significant variation of the load of the compressor(s) they are driving. Thus, in the art, it is preferred to keep drivers of compressor generators 'fully loaded' as the most efficient arrangement.

However, it is possible for the load of the refrigerant compressors 24, 28 to vary, based on a number of possible varying parameters or conditions in the cooling facility 1. For example, there may be variation in flow, volume, temperature, etc of the hydrocarbon stream 60, variation in the ambient conditions around the liquefaction facility 1, especially a high ambient temperature which can affect the efficiency of ambient coolers such as the ambient coolers 26, 32 shown in FIG. 2. Any inefficiency in the heat exchange of one or more streams in the pre-cooling or main heat exchangers 12, 22, or the use of one or more of the streams or units in the cooling facility 1 for one or more other duties such as cooling duty to an air separation unit (not shown), may also affect the load of the refrigerant compressors 24, 28 and their drivers 24*a*, 28*a*.

Thus, it is desired to optimise the cooling duties of the pre and main heat exchangers 12, 22, so as to optimise the operation of the compressor drivers 24*a*, 28*a*, and thus maintain them at their highest efficiency.

The method is able to better balance the cooling duty of the pre-cooling heat exchanger(s) 12 as provided by the expanded cooling stream 40*a*, by controlling the valve 14 using both the temperature T1 and the flow F1 monitoring, preferably measurements, of the cooled mixed refrigerant stream 20 provided by the pre-cooling heat exchanger(s) 12 measured values of these parameters can be used to immediately control operation of the valve 14, and therefore also control the flow F2 of the cooler cooling stream 40 into the pre-cooling heat exchanger(s) 12 (and/or the related flow F22 of the cooler cooling stream 30 in advance of the pre-cooling heat exchanger 12).

The shown method is particularly advantageous where the cooling stream is a mixed refrigerant, comprising one or more of the groups selected from: nitrogen, methane, ethane, ethylene, propane, propylene, butanes and pentanes.

The method shown is also particularly advantageous where the pre-cooling heat exchanger(s) 12 comprises one or more selected from the group comprising: one or more plate/fin heat exchangers, one or more spool wound heat exchangers, or a combination of both. Unlike kettle heat exchangers, such heat exchangers cannot be as easily controlled by the level of liquid therein.

The method shown is also particularly advantageous where it is desired to maintain the driver 28*a* of the main refrigerant compressor 28 at a 'maximum' or 'fully loaded' speed with minimized variation. That is, where the maximum power output of the driver is equal to the refrigerant compressor power consumption. The temperature T1 of the cooled mixed refrigerant stream 20 passing into the main heat exchanger 22 can be varied by the operation of the valve 14 and the flow F2 of the cooler cooling stream 40, so as to provide a desired temperature T1 for the mixed refrigerant stream 20.

It is noted that the temperature T1 and flow F1 of the cooled mixed refrigerant stream 20 are not inevitably linked or related. Thus, it is possible to have the same flow measurement at different temperatures, and different flow measurements at the same temperature. Thus, the present invention is advantageous by measuring both temperature T1 and flow F1 of the cooled mixed refrigerant stream 20, which provides a better control mechanism and feedback for operation of the valve 14, and thus balance between the cooling duty of the pre-cooling heat exchanger(s) 12 and the main heat exchanger 22.

Figure 3:
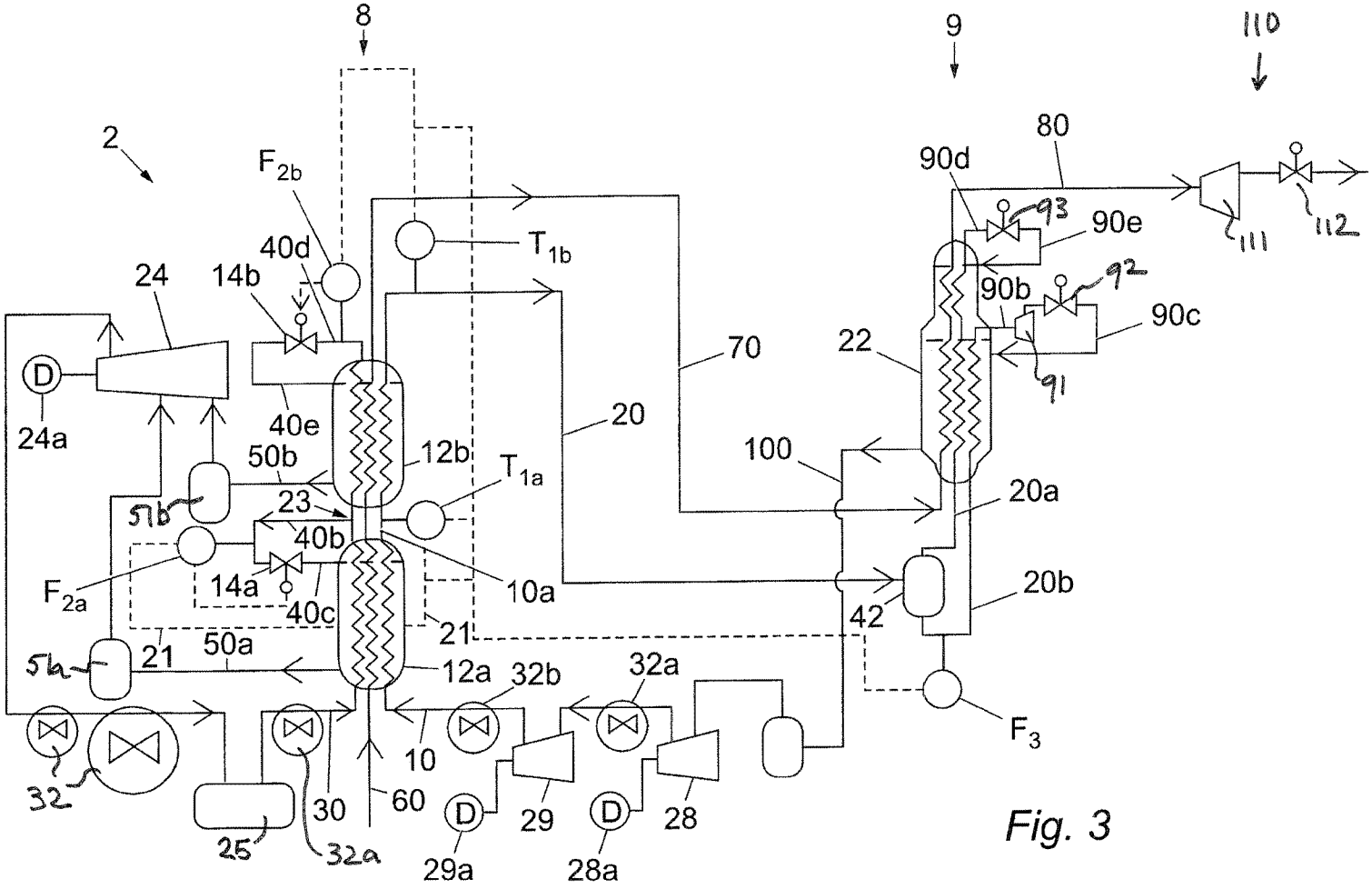
FIG. 3 is a scheme for liquefying a hydrocarbon stream.

FIG. 3 shows a liquefaction facility 2, in which a hydrocarbon stream 60 passes into a first pre-cooling heat exchanger 12*a*, then a second pre-cooling heat exchanger 12*b* as part of a first cooling stage 8, which cooled hydrocarbon stream 70 then passes into a main heat exchanger 22 as part of a second cooling stage 9, to provide a further cooled, preferably liquefied, hydrocarbon stream 80, which is more preferably liquefied natural gas. As usual, the liquefied hydrocarbon stream 80 is at an elevated pressure, at it may be depressurized in a so-called end flash system 110 which typically comprises an expander turbine 111 and a valve 112 followed by a gas/liquid separator (not shown).

In a first alternative, the hydrocarbon stream 60 passes only through the second pre-cooling heat exchanger 12*b* to provide the cooled hydrocarbon stream 70.

Through the first pre-cooling heat exchanger 12*a* also passes a mixed refrigerant stream 10 and a cooling stream 30. The mixed refrigerant stream 10 from the first pre-cooling heat exchanger 12*a* is provided as a part cooled mixed refrigerant stream 10*a*, which then passes into the second pre-cooling heat exchanger 12*b* to provide a cooled mixed refrigerant stream 20.

The cooling stream 30 passes into the first pre-cooling heat exchanger 12*a* and then is divided by a stream splitter or divider 23 known in the art to provide a part cooling stream 40*b* which is expanded through a first valve 14*a* to provide a first expanded cooling stream 40*c*, which then reenters the first pre-cooling heat exchanger 12*a* and provides cooling to the other streams there into. The first exit stream 50*a* from the first pre-cooling heat exchanger 12*a* passes through a suction drum 51*a* and then into a pre-cooling refrigerant compressor 24 driven by a driver 24*a*, prior to ambient cooling 32, collection in an accumulator 25, further cooling 32*a*, and then recirculation as the cooling stream 30.

Meanwhile, the other part of the cooling stream from the first pre-cooling heat exchanger 12*a* passes into the second pre-cooling heat exchanger 12*b*, where its cooled exit stream 40*d* passes through a second valve 14*b*, to provide a second expanded cooling stream 40*e* which passes back into the second pre-cooling heat exchanger 12*b* to provide cooling to other streams thereinto. The exit stream 50*b* from the second pre-cooling heat exchanger 12*b* passes through a suction drum 51*b* and then also into the pre-cooling refrigerant compressor 24 at a different pressure inlet for compression and cooling as described herein above.

FIG. 3 also shows that the temperature T1*a* of the part cooled mixed refrigerant stream 10*a* can be monitored, and the temperature T1*b* of the cooled mixed refrigerant stream 20 can also be monitored. Similarly, the flow of the part cooled cooling stream 40*b* prior to the first valve 14*a* can be monitored as F2*a*, and the flow of the cooled exit stream 40*d* from the second pre-cooling heat exchanger 12*b* can be monitored as F2*b* prior to the second valve 14*b*.

The cooled mixed refrigerant stream 20 passes into a gas/liquid separator 42, so as to provide a lighter stream 20*a*, generally being methane-enriched, and a heavier stream 20*b*, generally being heavier-hydrocarbon enriched. In a manner known in the art, the lighter stream 20*a* passes through the main heat exchanger 22 to provide an overhead stream 90*d* which is expanded at valve 93 and passed back as a first expanded stream 90*e* into the main heat exchanger 22. The heavier stream 20*b* is similarly passed into the main heat exchanger 22 and outflows as stream 90*b* at a lower level than the lighter overhead stream 90*d*. Stream 90*b* can be expanded by one or more expanders (e.g. expansion units or means) such as a turbine 91 and valve 92, prior to passing back into the main heat exchanger 22 as a second expanded stream 90*c*.

The mixed refrigerant from the main heat exchanger 22 is provided as a main exit stream 100, which passes through one or more compressors, etc, such as the two main refrigerant compressors 28, 29 shown in FIG. 3, each being driven by a driver 28*a*, 29*a* respectively, with ambient cooling after each compressor provided by ambient coolers 32*a*, 32*b* in a manner known in the art.

In the arrangement shown in FIG. 3, flow F3 of the heavier stream 20*b* can be monitored in place of monitoring of the flow F1 of the complete mixed refrigerant stream 20 after the pre-cooling heat exchangers 12*a*, 12*b*. In this way, the temperature of the mixed refrigerant either at point T1*a* and/or T1*b* can be used to control the ratio between the flow F3 of the heavier stream 20*b* and either the flow F2*a* of part cooled cooling stream 40*b* and/or the flow F2*b* of the cooled cooling stream 40*d*.

Thus, operation of the valves 14*a*, 14*b* can relate to the flow F3 of the heavier stream and one or more of the temperatures T1*a* and T1*b* of the mixed refrigerant stream after its cooling by the first pre-cooling heat exchanger 12*a*, and/or the second pre-cooling heat exchanger 12*b*.

The temperature T1*b* can be used with the flow F3 to influence the flow F2*b* and its associated valve 14*b*. Similarly, the temperature T1*a* can be used with the flow F3 to influence the flow F2*a* and its associated valve 14*a*.

Preferably, the flows F2*a* and F2*b* are both controlled to optimize the cooling duty of each of the first and second pre-cooling heat exchangers 12*a*, 12*b*, and thus the compression power needed by the pre-cooling refrigerant compressor 24, and in particular the energy input required by its driver 24*a*.

Figure 4:
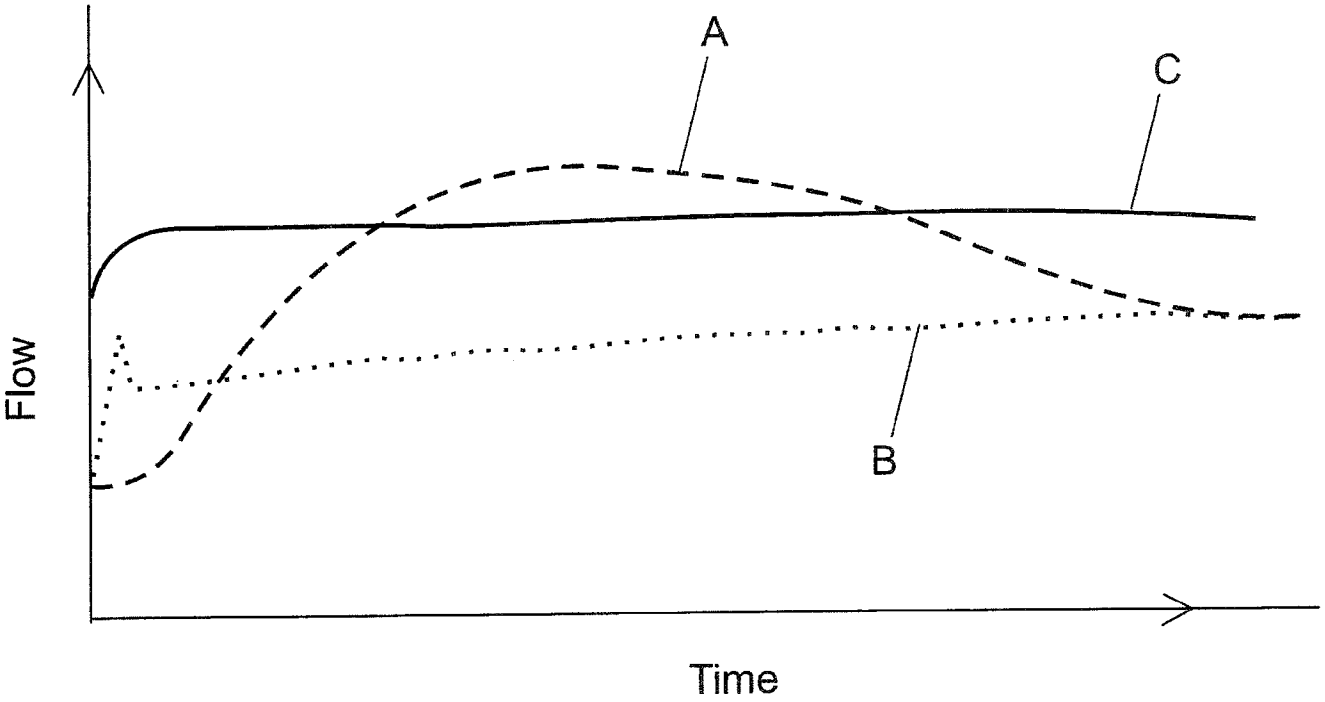
FIG. 4 shows graphs of comparative and present invention flows for a cooling stream cooling the mixed refrigerant stream, against time.

FIG. 4 shows changes of flow over time for cooling streams shown in the arrangement of FIG. 2, in comparison to a comparative arrangement for the same flow.

For both arrangements, FIG. 4 shows the change in the flow (line C) of a mixed refrigerant stream 10 or a cooled mixed refrigerant stream 20, both flows being related values. In FIG. 2, the flow of the mixed refrigerant stream 10 or the cooled mixed refrigerant stream 20 can be increased by opening, or further opening, of the main valve 27 associated with the one or more second heat exchangers 22. The main valve 27 may be opened or further opened in a desire to increase production of the liquefied hydrocarbon stream 80, or in response to a change in the flow of the hydrocarbon stream 60, or one or more other reasons known to those skilled in the art in operating a cooling, preferably liquefaction, process or facility.

In response to increasing the flow of the mixed refrigerant stream 10, there will be an increase in the cooling duty required in the pre-cooling heat exchanger(s) 12, to provide the same level of cooling to the mixed refrigerant stream 10 at its increased flow rate.

In FIG. 4, the change in the opening of the main valve 27 is shown by the vertical increase at the start of the flow line C, which then proceeds overtime at the higher flow rate (across the graph).

To provide the higher cooling duty in the pre-cooling heat exchanger(s) 12, a common method is to open or further open the pre-cooling valve 14 so as to increase the flow and/or amount of the expanded cooling stream(s) 40*a* into the pre-cooling heat exchanger(s).

Line A in FIG. 4 shows the change in flow of the expanded cooling stream 40*a* over time in a comparative arrangement, based on the valve 14 changing in response to measurement of the temperature only of the cooled mixed refrigerant stream 20. Thus, it can be seen that there is a massive over-reaction, such that the flow of the cooling stream 30 is in excess of that required, which excess then needs to be worked through prior to any steadying of the cooling stream 30 over time.

Line B in FIG. 4 shows the change in flow of the expanded cooling stream 40*a* based on the present invention, i.e. where the pre-cooling valve 14 is operated in response to measurement of both the temperature and the flow of the cooled mixed refrigerant stream 20, as well as flow of the cooling stream or cooler cooling stream 40. Line B clearly shows a slow and steady increase of the expanded cooling stream flow over time.

The difference between lines A and B in FIG. 4 requires a significantly increased power consumption to provide for line A. Thus, the better-aligned and more-steady line B is clearly more efficient in providing the desired cooling duty in the pre-cooling heat exchanger(s) 12, making the pre-cooling heat exchanger(s) 12 significantly more efficient during any change in the flow of the cooled mixed refrigerant stream 20. The present invention is also faster to respond to changes in the flow of the cooled mixed refrigerant stream 20, and more accurate by being closer to achieving the change in cooling duty required significantly earlier than that shown by the comparative arrangement.

The method includes a method of cooling a mixed refrigerant stream and controlling a valve for use in said methods and apparatus.

It will be clear to the skilled person that the present invention also provides a method of controlling an expander such as a valve for expanding at least part of a cooling stream for use in a heat exchanger, comprising at least the steps of:

(a) providing a mixed refrigerant stream;

(b) passing the mixed refrigerant stream through a heat exchanger to provide a cooled mixed refrigerant stream;

(c) monitoring the temperature (T1) and the flow (F1) of at least part of the cooled mixed refrigerant stream;

(d) providing a cooling mixed refrigerant stream and monitoring the flow (F2) of at least part thereof;

(e) expanding at least a fraction of the cooling stream through the valve expander to provide an expanded cooling stream;

(f) passing the expanded cooling stream through one or more of the heat exchangers in step (b) to cool the mixed refrigerant stream; and (g) controlling the valve expander to control the flow F2 of at least part of the cooling stream using the flow F1 and the temperature T1 of at least part of the cooler mixed refrigerant stream.

Moreover, it will be clear to the skilled person that the present invention also provides an expander controller for a method and/or apparatus as defined hereinbefore at least comprising:

one or more inputs and outputs to receive measured values for the temperature (T1) and flow (F1) of the cooled mixed refrigerant stream and for the flow (F2) of the cooling stream, and to control the expander(s).

The present methods and apparatuses may improve refrigerant loads through one or more heat exchangers and to improve the efficiency of a cooling, preferably liquefying, process and apparatus.

The present methods and apparatuses may improve the cooling of a mixed refrigerant stream through one or more heat exchangers prior to its use to liquefy a hydrocarbon stream such as natural gas.

The present methods and apparatuses may reduce the power consumption of a method of cooling a mixed refrigerant stream, especially one used in a method and apparatus for cooling, optionally including liquefying, a hydrocarbon stream.

The present methods and apparatuses may decrease the time required to shift or adjust refrigeration load between a pre-cooling refrigeration cycle and a main refrigeration cycle of a cooling, optionally liquefying, hydrocarbon process.

The person skilled in the art will understand that the present invention can be carried out in many various ways without departing from the scope of the appended claims.

What is claimed is:

1. A method of cooling a hydrocarbon stream comprising the steps of:

(a) providing a first mixed refrigerant stream comprising a first mixed refrigerant;

(b) using at least one first compressor driven by at least one first compressor driver maintained at a constant first speed for passing the first mixed refrigerant stream through one or more first heat exchangers to provide a cooled first mixed refrigerant stream;

(c) monitoring the temperature (T1) and the flow rate (F1) of at least part of the cooled first mixed refrigerant stream, and passing measured values of the temperature (T1) and the flow rate (F1) to a controller;

(d) using at least one second compressor driven by at least one second compressor driver maintained at a constant second speed for providing a second mixed refrigerant stream comprising a second mixed refrigerant, wherein the average molecular weight of the second mixed refrigerant stream is greater than the average molecular weight of the first mixed refrigerant stream;

(e) monitoring the flow rate (F2) of at least part of the second mixed refrigerant stream provided in step (d), and passing a measured value of the flow rate (F2) to the controller;

(f) passing at least a first fraction of the second mixed refrigerant stream through an expander to provide one or more expanded second mixed refrigerant streams;

(g) passing a second fraction of the second mixed refrigerant stream into a different one or more of the first heat exchangers than the first fraction, and passing at least one of the one or more expanded second mixed refrigerant streams through one or more of the first heat exchangers to cool the first mixed refrigerant stream thereby providing the cooled first mixed refrigerant stream;

(h) controlling the temperature of the cooled first mixed refrigerant stream by controlling the flow rate (F2) of the second mixed refrigerant stream by controlling the expander with the controller;

(i) using the cooled first mixed refrigerant stream to cool the hydrocarbon stream, wherein step (i) comprises: (i1) passing the cooled first mixed refrigerant stream through at least one main heat exchanger and (i2) passing the hydrocarbon stream through the at least one main heat exchanger to be cooled by the cooled first mixed refrigerant stream or at least part thereof.

2. The method as claimed in claim 1, wherein at least a part of the second mixed refrigerant stream also passes through the one or more of the first heat exchangers in step (b), to provide one or more cooler second mixed refrigerant streams prior to passing at least a fraction of the second mixed refrigerant stream through the expander in step (f).

3. The method as claimed in claim 2, wherein the flow rate (F2) of at least part of the second mixed refrigerant stream is monitored as the flow rate of at least part of a cooler second mixed refrigerant stream.

4. The method as claimed in claim 1, wherein, prior to step (i), the first mixed refrigerant stream is passed through any number from 1 to 6 first heat exchangers, and wherein a different expanded second mixed refrigerant stream of the one or more expanded second mixed refrigerant streams from step (f) is passed through each first heat exchanger cooling the first mixed refrigerant stream.

5. The method as claimed in claim 4, wherein the temperature (T1*a*, T1*b*) and the flow rate (F1*a*, F1*b*) of the cooled first mixed refrigerant stream is monitored downstream of each of the first heat exchangers.

6. The method as claimed in claim 1, wherein the hydrocarbon stream also passes through at least one of the first heat exchangers prior to step (i).

7. The method as claimed in claim 1, wherein, prior to step (i), the cooled first mixed refrigerant stream is separated into a lighter stream and a heavier stream.

8. The method as claimed in claim 7, wherein the using, in step (i), of the cooled first mixed refrigerant stream to cool the hydrocarbon stream comprises heat exchanging the hydrocarbon stream against the lighter stream and the heavier stream.

9. The method as claimed in claim 7, wherein monitoring the flow rate (F1) of at least part of the cooled first mixed refrigerant stream comprises monitoring the flow rate (F3) of the heavier stream.

10. The method as claimed in claim 9, wherein the heavier stream defines the at least part of the cooled first mixed refrigerant stream.

11. The method as claimed in claim 1, wherein the hydrocarbon stream is liquefied in the main heat exchanger during the passing of the hydrocarbon stream through the at least one main heat exchanger, to provide a liquefied hydrocarbon stream, such as liquefied natural gas.

12. The method of claim 1, comprising:

maintaining the at least one first compressor driver at a constant first speed, the constant first speed being full speed of the first compressor driver, and maintaining the at least one second compressor driver at a constant second speed, the second speed being full speed of the second compressor driver.

* * * * *